United States Patent [19]

Zaruba et al.

[11] Patent Number: 4,662,633

[45] Date of Patent: May 5, 1987

[54] BIASED RECEPTACLE ACTION GAME

[75] Inventors: John V. Zaruba, Chicago; Donald A. Rosenwinkel, Oak Park; Jeffrey D. Breslow, Highland Park, all of Ill.

[73] Assignee: Marvin Glass & Associates, Chicago, Ill.

[21] Appl. No.: 821,050

[22] Filed: Jan. 22, 1986

[51] Int. Cl.[4] ..... A63F 9/00

[52] U.S. Cl. ..... 273/1 GF; 446/5

[58] Field of Search ..... 273/1 G, 1 GG, 1 GF; 446/6, 5, 4

[56] References Cited

U.S. PATENT DOCUMENTS

| | | | |
|---|---|---|---|
| 3,565,425 | 2/1971 | Breslow | 273/1 GF |
| 3,668,804 | 6/1972 | Winston | 446/6 |
| 4,324,065 | 4/1982 | Cooper | 273/1 GF |

FOREIGN PATENT DOCUMENTS

| | | | |
|---|---|---|---|
| 2012601 | 8/1979 | United Kingdom | 446/4 |
| 2083367 | 3/1982 | United Kingdom | 273/1 GF |

OTHER PUBLICATIONS

Schaper Toys Catalog, 1978, 3-1978, p. 7, The Last Straw.

*Primary Examiner*—Paul E. Shapiro

*Attorney, Agent, or Firm*—John S. Pacocha

[57] ABSTRACT

A game involving the insertion of simulated articles of dirty clothing into a washing machine receptacle, the sides of which are biased to explode open. The number and type of articles to be inserted during a turn is determined by a spinner. Insertion of the articles through an opening in the top wall of an otherwise substantially enclosed receptacle, eventually effects downward movement of the bottom to which the sidewalls are pivotably mounted. Once the bottom and sidewalls move down enough to disengage the upper edges of the sidewalls, the sides of the washing machine receptacle spring outwardly, spewing out the laundry.

19 Claims, 7 Drawing Figures

Fig 1
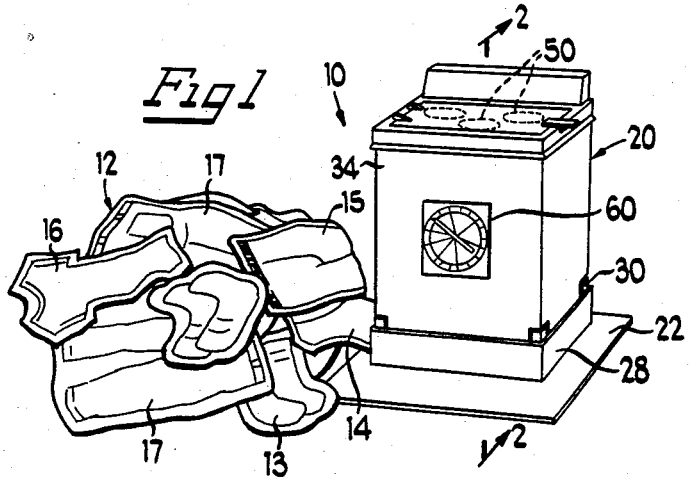
Fig 6
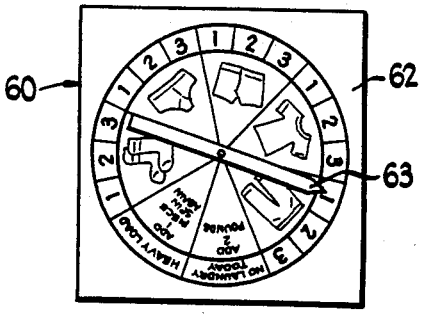
Fig 7
| NAME | MO | TU | WE | TH | FR | TOTAL |
|---|---|---|---|---|---|---|
| | | | | | | |
65
Fig 2
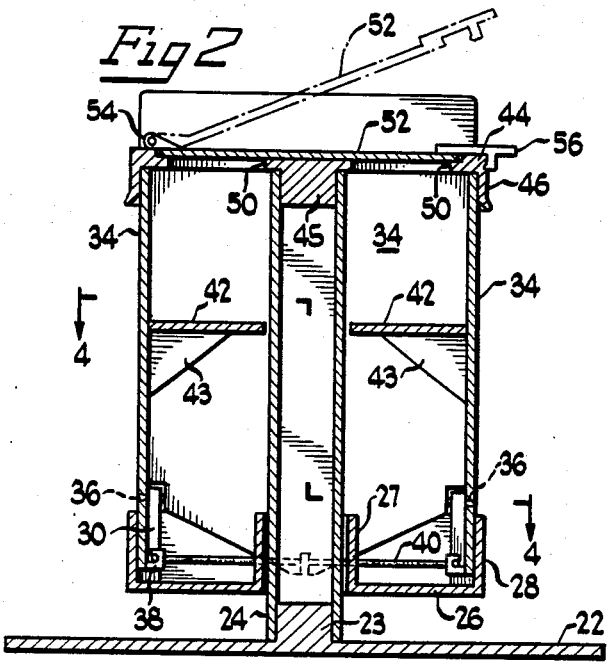
Fig 4
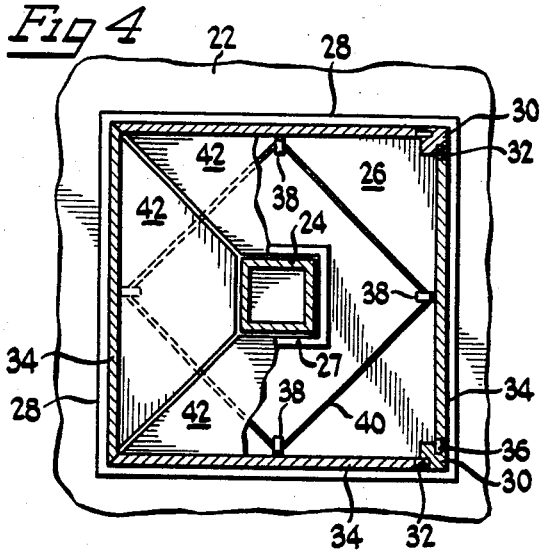
Fig 3
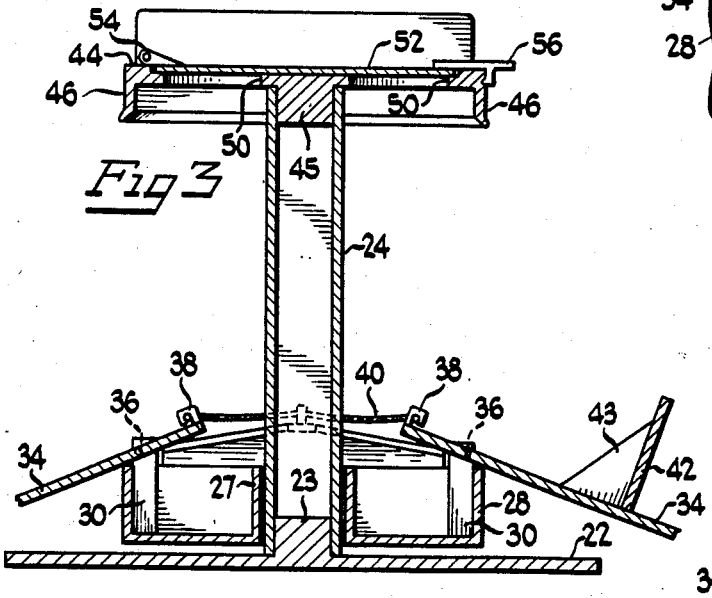
Fig 5
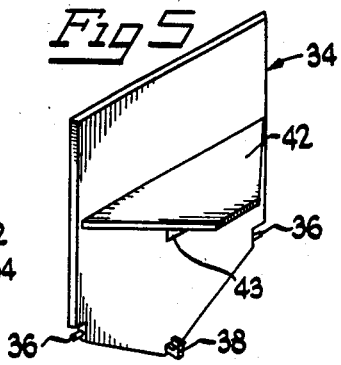

BIASED RECEPTACLE ACTION GAME

BACKGROUND OF THE INVENTION

1. Field of the Invention

This application relates to games and more particularly to action games in which the players try to avoid a disaster.

2. Background Art

Games which combine some element of chance and skill to avoid, or at least postpone, the occurrence of disastrous events are old in the art. Examples of such games are PICK UP STICKS, TIP IT, and DON'T COOK YOUR GOOSE, the latter two being shown in U.S. Pat. Nos. 3,402,929 and 3,656,746, respectively. There remains, however, a need for such entertaining games.

SUMMARY OF THE INVENTION

The present invention is concerned with providing a game that involves the elements of chance selection, some physical skill and the inevitable occurrence of a disastrous conclusion in an entertaining manner. This and other objects and advantages of the invention are achieved in a game including a plurality of various types of simulated clothing articles, a chance device for determining a number and type of article and a receptacle latched against a bias which will eventually be triggered by the placement of articles within the receptacle. Compatible with the simulated clothing, the receptacle is a simulated, substantially enclosed washing machine, the sides of which are latched against a bias urging them open. Insertion of the simulated clothing articles through an opening in the top of the washing machine urges the bottom down about a base mounted column. Above, but near the bottom of their lower edges, the sides are mounted on the bottom for outward pivotal movement and latched closed adjacent their upper edges by the top, downward movement of the bottom will eventually disengage the latch and the bias will open all of the sides simultaneously and disgorge the simulated chance device, players determine how many of what type of simulated clothing article they must put in the washing machine during a turn. If the player successfully inserts all of the laundry in the machine without it exploding, points are awarded the player. Once the machine does explode the round of play ends and all players other than the one causing the disaster will receive additional points.

BRIEF DESCRIPTION OF THE DRAWINGS

For a better understanding of the present invention reference may be had to the accompanying drawings in which:

FIG. 1 is a perspective view of a game embodying the present invention;

FIG. 2 is an enlarged scale, sectional view taken generally along line 2—2 of FIG. 1;

FIG. 3 is a sectional view like that of FIG. 2, but showing the receptacle with its sides open;

FIG. 4 is a sectional view taken generally along line 4—4 of FIG. 2;

FIG. 5 is a reduced scale perspective view of the inside of one of the sidewalls;

FIG. 6 is an enlarged scale view of the chance device; and

FIG. 7 is a top plan view of a score sheet usable with the present invention.

DETAILED DESCRIPTION OF THE PREFERRED EMBODIMENT

Referring now to the drawings in which like parts are designated by like reference numerals throughout the several views, FIG. 1 shows a game 10 with a pile of simulated articles of clothing 12, such as socks 13, underwear 14, shorts 15, shirts 16, and pants 17. Particularly, since the simulated clothing articles may be made by die cutting them out of a variety of inexpensive materials, such as cloth, thin flexible plastic, or even paper, a large number of such articles may be included with the game. For example, ten of each different type of simulated clothing could be provided for a total of fifty articles. In addition to cost, the choice of material is only limited by the requirements that the articles can be deformed and later returned to an approximation of their original shape. It is not necessary in this invention that the articles have the property of returning to substantially their identical original shape on their own. Moreover, since the articles are to represent simulated clothing about to be washed, it is not detrimental that after a number of uses in which the articles are deformed and then returned to an approximation of their original shape, they become wrinkled. The fact that some of the articles such as the pants 17 are significantly larger than, for example, the socks 13 becomes part of the play of the game.

A receptacle 20 styled to simulate a washing machine is provided for player insertion of the simulated clothing articles. Receptacle 20 includes a substantially flat base 22, with a generally disposed upright post 23 onto which is secured an upright column 24. Received for up and down movement about the column is a square bottom wall 26, which includes an inner, generally, upright sleeve 27 that conforms in shape, but is slightly larger than the outer dimensions of column 24. About its outer peripheral edge, bottom wall 26 has a generally upwardly extending peripheral flange 28. Inside each corner of flange 28 is a mounting block 30 that extends above the flange. Each block has a bore 32 in each of its inwardly facing sides at substantially the same height above the top of flange 28.

As illustrated, washing machine receptacle 20 has four identical sides 34. Near the lower edge of each side, a pair of coaxial stubshafts 36 extend out from the lateral edges. Each stubshaft 36 is journaled in a respective bore 32 in one of the mounting blocks. Accordingly, each side is mounted for up and down movement with bottom wall 26 and also for pivotal movement from a generally upright position through approximately ninety degrees to an outer open position as illustrated in FIG. 3. Substantially at the center of the bottom edge, a hook 38 extends in from the inner face of sidewall 34. A single elastic band 40 is attached to each of the four hooks 38 to bias the bottom of all four of the sides inwardly and urge each of the sides to pivot about their coaxial stubshaft 36 into the open position illustrated in FIG. 3. Intermediate their upper and lower edges, each sidewall 34 has an inwardly directed trapezoidal shelf 42, below which is a bracing member 43.

Atop column 24, a top wall 44 is mounted by means of a generally centrally disposed plug 45. Depending from the periphery of top wall 44 is a skirt 46. Like bottom wall 26, top wall 44 is square and the inner dimension from one side of depending skirt 46 to the other is approximately equal to the inner dimension from one side to the other of upstanding outer flange 28. When bottom wall, carrying sidewalls 34 manually compressed together against the bias of band 40, is moved up and under top 44, the upper edges of each of the sidewalls bear against the inner faces of depending skirt 46. The combination of the frictional engagement between sleeve 28 and column 24, together with the frictional engagement of the abutting portions of the upper parts of each of the sidewalls with depending skirt 46 is sufficient to maintain the bottom wall in its upward raised position spaced from the base, as shown in FIG. 2 and maintain the sides of the receptacle closed. However, insertion of enough of the articles 12 exerting a downward force on shelves 42 will eventually force the bottom wall down toward the base and move sidewalls 34 out of engagement with depending skirt 46, permitting the bias of the band 40 to pivot open the sidewalls 34 and throw or explode out the simulated articles of clothing. Because of the higher position of shelves 42, articles resting upon it are thrown out more vigorously and further than if the articles where stuffed all the way down to the bottom of the receptacle.

Top wall 44 is provided with three openings 50 for insertion of the articles. It is possible, to cause an explosion with less than a full load of simulated clothing articles, if enough of the articles are concentrated within one area to cause sufficient downward movement of bottom wall 26. Accordingly, since receptacle 20 is substantially enclosed except for the three openings 50, players have to pay attention to what openings the opposing players have used for the insertion of their articles. To insure that a player has properly inserted the articles all the way into the receptacle 20, a lid 52 is provided. The lid fits flush with the upper surface of top wall 44. Hinges 54 along one edge provide for opening and closing of the lid and a latch 56 is provided at the edge opposite the hinges.

In order to determine what articles of clothing a player must put into receptacle 20 during a turn, a spinner 60 is provided. As illustrated in FIG. 1, the spinner may be mounted on one wall of the receptacle. Each article of clothing is depicted in a radial division of the spinner plate 62 and further radial subdivisions indicate a number "1", "2" and "3" for each type of article. In addition, there is a radial division reading "NO LAUNDRY TODAY—ADD 2 POUNDS" and another radial portion reading "HEAVY LOAD—ADD 1 PIECE—SPIN AGAIN". Mounted for rotation on plate 62 is a pointer 63. A score card 65, as illustrated in FIG. 7, is provided for playing a number of rounds, each round being designated by a day of the week.

After designating an order of play, one player is conveniently appointed as the scorekeeper. At the onset, the washing machine receptacle is set by manually compressing the sides 34 against the bias of the band 40 and moving the sides and bottom up to the top, until the upper edges of the sides engage the insides of peripheral skirt 46. Play begins with the starting player's use of the spinner. If the pointer stops in one of the simulated clothing divisions, the player then lifts the lid of the washing machine and inserts the designated number of the type of article into an opening 50 of the player3 s choice. Of course, a larger size article such as pants 17 is more likely to trip the release of sidewalls 34, particularly as washing machine 20 becomes full. Provided the washing machine does not explode, the player receives one point for each article added. Should the pointer stop in the "NO LAUNDRY TODAY" division, the player receives two free points and passes the spinner. When the pointer lands in the "HEAVY LOAD" division, the player must insert one article of the player's own choice into the receptacle and then spin again. Once a particular type of article is used up, if the pointer lands in the division of that type, the player gets the number of points indicated as if the player had successfully inserted the number of articles. At the end of every turn a player completes without the washing machine exploding, the score keeper adds the points to the player's score. However, when a player, while putting articles into one of the openings, or closing of the lid, causes the washing machine to explode, the round of play ends and every other player receives five points. At the end of five rounds or "days" of doing dirty laundry, the player with the highest point total wins the game.

While a particular embodiment of the present invention has been shown and described, it will be apparent to those skilled in the art that changes and modifications may be made. It is intended in the appended claims to cover all such changes and modifications as fall within the true spirit and scope of the present invention.

What is claimed as new and desired to be secured by Letters Patent is:

1. A game comprising in combination:
- a plurality of each of various types of articles;
- chance means for determining both a number and type of article;
- a multisided receptacle for the articles;
- the receptacle being substantially enclosed except for at least one opening in one of the walls;
- means biasing a number of the walls to open;
- means latching the walls closed against the bias; and
- means tripping open the latch upon insertion of articles effecting a predetermined condition.

2. The game of claim 1 in which the receptacle has:
- a top wall;
- a spaced apart bottom wall generally parallel to the top wall; and
- a plurality of opposed sidewalls extending between and generally transverse to the top and bottom walls.

3. The game of claim 2 in which the number of walls biased open is all of the opposed sidewalls.

4. The game of claim 2 including:
- a base with a generally centrally disposed, upright column supporting the receptacle;
- with the top wall being stationary with respect to the base and column; and
- the bottom wall and opposed sidewalls being movable along the column from an uppermost position to a lowermost position.

5. The game of claim 4 in which the top wall has a depending peripheral skirt which engages and frictionally retains the bottom wall and opposed sidewalls in the uppermost position.

6. The game of claim 4 in which the bottom wall has an upwardly extending peripheral flange conforming to, but outward of, the periphery defined by the opposed sides.

7. The game of claim 4 in which the bottom wall has a generally centrally disposed aperture to accommodate the column and an inner, generally upwardly extending sleeve about the column.

8. The game of claim 4 including means on the bottom wall mounting each of the opposed sides for pivotal movement from the receptacle forming position in which the sidewalls extend between and are generally transverse to the top and bottom walls, through approximately ninety degrees to a second position in which the opposed sides open outwardly of the periphery of the top wall.

9. The game of claim 8 in which:

each of the opposed sidewalls has a lower edge beneath the mounting means; and the biasing means is connected to each opposed sidewall adjacent its respective lower edge to simultaneously open all of the opposed sidewalls.

10. The game of claim 9 in which:

each of the opposed sidewalls has an upper edge spaced from and opposite the lower edge; and the latching means includes engagement between the top wall and each opposed sidewall adjacent its respective upper edge.

11. The game of claim 10 in which the top wall has a depending peripheral skirt that engages the sidewalls adjacent their respective upper edges.

12. The game of claim 10 in which the tripping means includes the downwardly movable bottom wall.

13. The game of claim 10 in which the predetermined condition is simultaneous downward movement of the upper edges out of engagement with the top wall.

14. The game of claim 10 in which each opposed sidewall has an inwardly extending shelf disposed between its upper edge and lower edge with the shelf being generally parallel to and spaced between the top and bottom walls.

15. The game of claim 1 in which the one wall has a number of openings.

16. The game of claim 1 including a lid that fits flush against the outside of the one wall and covers the opening.

17. A method of playing a game comprising the steps of:

supplying a receptacle releasably latched against a bias, a plurality of each of various types of articles, and a chance device for determining both the number and type of article;

designating an order of turns for more than one player;

each player in turn using the chance device to determine a number and type of article for the player for that turn;

the player then inserting the chance determined number and type of article into the receptacle; and awarding the player a predetermined number of points for each article placed in the receptacle without releasing the latch.

18. The method of claim 17 including the step of granting the player the predetermined number of points for each article determined by the player's use of the chance device when that type of article is no longer available in the supply.

19. The method of claim 17 including the steps of:

ending a round of play upon one of the players releasing the latch;

granting each player other than the player releasing the latch a number of points;

relatching the receptacle; and continuing play for an additional preselected number of rounds.

* * * * *